US008727730B2

(12) United States Patent
Liotta et al.

(10) Patent No.: US 8,727,730 B2
(45) Date of Patent: May 20, 2014

(54) COMPOSITE TURBINE BUCKET ASSEMBLY

(75) Inventors: Gary Charles Liotta, Simpsonville, SC (US); Andres Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 662 days.

(21) Appl. No.: 12/754,689

(22) Filed: Apr. 6, 2010

(65) Prior Publication Data

US 2011/0243746 A1 Oct. 6, 2011

(51) Int. Cl.
*F01D 5/30* (2006.01)

(52) U.S. Cl.
USPC ..... 416/193 A; 416/219 R

(58) Field of Classification Search
USPC ..... 416/193 A, 248, 221, 219 R, 217
See application file for complete search history.

(56) References Cited

U.S. PATENT DOCUMENTS

| | | | | | |
|---|---|---|---|---|---|
| 1,362,074 | A | * | 12/1920 | Baumann | 416/217 |
| 3,002,675 | A | * | 10/1961 | Howell et al. | 417/352 |
| 3,012,308 | A | * | 12/1961 | Zech et al. | 29/889.7 |
| 3,034,764 | A | * | 5/1962 | Davis et al. | 416/210 R |
| 3,132,841 | A | * | 5/1964 | Wilder, Jr. | 416/219 R |
| 3,702,222 | A | * | 11/1972 | Bernales | 416/212 R |
| 3,719,431 | A | * | 3/1973 | Steele et al. | 416/96 R |
| 3,801,222 | A | * | 4/1974 | Violette | 416/220 R |
| 4,045,149 | A | * | 8/1977 | Ravenhall | 416/135 |
| 4,084,922 | A | | 4/1978 | Glenn | |
| 4,093,399 | A | * | 6/1978 | Glenn | 416/95 |
| 4,094,615 | A | | 6/1978 | Glenn | |
| 4,111,603 | A | * | 9/1978 | Stahl | 416/95 |
| 4,142,836 | A | * | 3/1979 | Glenn | 416/193 A |
| 4,595,340 | A | * | 6/1986 | Klassen et al. | 416/193 A |
| 5,062,767 | A | * | 11/1991 | Worley et al. | 415/209.3 |
| 5,222,865 | A | * | 6/1993 | Corsmeier | 416/193 A |
| 5,372,481 | A | | 12/1994 | Boyd | |
| 5,405,244 | A | * | 4/1995 | Boyd | 416/214 A |
| 5,405,245 | A | | 4/1995 | Cornelius | |
| 5,431,541 | A | | 7/1995 | Shaffer | |
| 5,435,693 | A | | 7/1995 | Shaffer | |
| 5,580,219 | A | | 12/1996 | Frey et al. | |
| 5,743,713 | A | | 4/1998 | Hattori et al. | |
| 6,129,512 | A | * | 10/2000 | Agram et al. | 415/160 |
| 6,193,141 | B1 | * | 2/2001 | Burke et al. | 228/190 |
| 7,094,021 | B2 | | 8/2006 | Haubert | |
| 7,972,113 | B1 | * | 7/2011 | Davies | 416/214 A |
| 2007/0128043 | A1 | * | 6/2007 | Morrison et al. | 416/241 B |
| 2007/0183897 | A1 | * | 8/2007 | Sadler et al. | 416/223 R |

* cited by examiner

*Primary Examiner* — Nathaniel Wiehe
*Assistant Examiner* — Joshua R Beebe
(74) *Attorney, Agent, or Firm* — Nixon & Vanderhye P.C.

(57) ABSTRACT

A composite turbine blade assembly includes a ceramic blade including an airfoil portion, a shank portion and an attachment portion; and a transition assembly adapted to attach the ceramic blade to a turbine disk or rotor, the transition assembly including first and second transition components clamped together, trapping said ceramic airfoil therebetween. Interior surfaces of the first and second transition portions are formed to mate with the shank portion and the attachment portion of the ceramic blade, and exterior surfaces of said first and second transition components are formed to include an attachment feature enabling the transition assembly to be attached to the turbine rotor or disk.

19 Claims, 3 Drawing Sheets

COMPOSITE TURBINE BUCKET ASSEMBLY

This invention was made with Government support under Contract No. DE-FC26-05NT42643, awarded by the Department of Energy. The Government has certain rights in the invention.

This invention relates to gas turbine blades or buckets and, more specifically, to a transition assembly that enables attachment of a ceramic matrix composite (CMC) turbine blade to a metal turbine disk or rotor.

BACKGROUND OF THE INVENTION

Currently, methods utilized for connecting a CMC blade to a metal turbine disk or rotor involve the use of mechanical means such as bolts that connect the ceramic blade directly to the rotor system. Alternatively, the turbine disk or rotor may be designed specifically with a CMC system in mind. The current systems do not, however, allow for direct field replacement of a metal alloy blade with a CMC blade on an existing metal disk or rotor without excessive cost and considerable additional complexity. There remains a need therefore, for simple and cost-effective system by which CMC blades may be retrofitted to existing metal turbine rotors or disks.

BRIEF DESCRIPTION OF THE INVENTION

In a first exemplary but nonlimiting embodiment, the present invention relates to a composite turbine blade assembly comprising a ceramic blade including an airfoil portion, a shank portion and an attachment portion; and a transition assembly adapted to attach the ceramic blade to a turbine disk or rotor, the transition assembly comprising first and second metal transition components clamped together, trapping the ceramic blade therebetween; wherein interior surfaces of the first and second metal transition components are formed to mate with the shank portion and the attachment portion of the ceramic blade; and wherein exterior surfaces of the first and second metal transition components are formed to include an attachment feature enabling the transition assembly to be attached to the turbine rotor or disk.

In another exemplary but non-limiting embodiment, the present invention relates to a composite turbine blade assembly comprising a ceramic blade including an airfoil portion, a shank portion and a first dovetail attachment portion; and a transition assembly adapted to attach the ceramic blade to a turbine disk or rotor, the transition assembly comprising first and second transition components clamped together, trapping the ceramic blade therebetween; wherein interior surfaces of the first and second transition components are formed to mate with the shank portion and the first dovetail attachment portion of the ceramic blade; and wherein exterior surfaces of the first and second transition components are formed to include a second dovetail attachment portion enabling the transition assembly to be attached to the turbine rotor or disk.

In still another exemplary but nonlimiting embodiment, the invention relates to a turbine rotor or disk assembly comprising at least one ceramic blade including an airfoil portion, a shank portion and a first attachment portion; and a transition assembly adapted to attach the at least one ceramic blade to a turbine disk or rotor, the transition assembly comprising first and second transition portions clamped together, trapping the at least one ceramic airfoil therebetween; wherein interior surfaces of said first and second transition portions are formed to mate with the shank portion and the first attachment portion of the at least one ceramic blade; and wherein exterior surfaces of the first and second sections are formed to include a platform, shank, plural angel wing seals and second attachment portion enabling the transition assembly to be attached to the turbine rotor or disk.

The invention will now be described in detail in connection with the drawings identified below.

DETAILED DESCRIPTION OF THE DRAWINGS

An exemplary but nonlimiting embodiment relates to a novel transition mechanism for attaching a ceramic turbine airfoil to a metal turbine disk or rotor. As explained further below, the transition mechanism or assembly allows for a lower cost CMC airfoil or blade with minimal features and appendages, greatly reducing both complexity and cost. Moreover, the design disclosed herein allows for a ceramic blade to replace a metallic blade without compromising the design of the existing rotor system. The transition assembly, by which the ceramic blade is attached to the turbine disk or rotor, is constructed from two or more metal transition components, secured together, with the CMC blade therebetween. More specifically, the components of the transition assembly are clamped together directly with one or more bolts or other suitable fasteners at a location radially inward of the ceramic blade, i.e., the bolts or other fasteners do not pass through the ceramic blade. The two components of the transition assembly can be sectored in a plurality of ways to optimize weight and stress and to otherwise conform to the ceramic blade.

All of the typical external metal turbine bucket or blade design features may be included on the transition components, including, for example, angel wing seals, platform, shank, dovetail and any cooling delivery and/or cooling features typically associated with the platform, shank and mounting portions of a bucket. Since these complex features are incorporated into the transition components, the ceramic blade itself may be relatively simple in design and relatively easy to manufacture.

Figure 1:
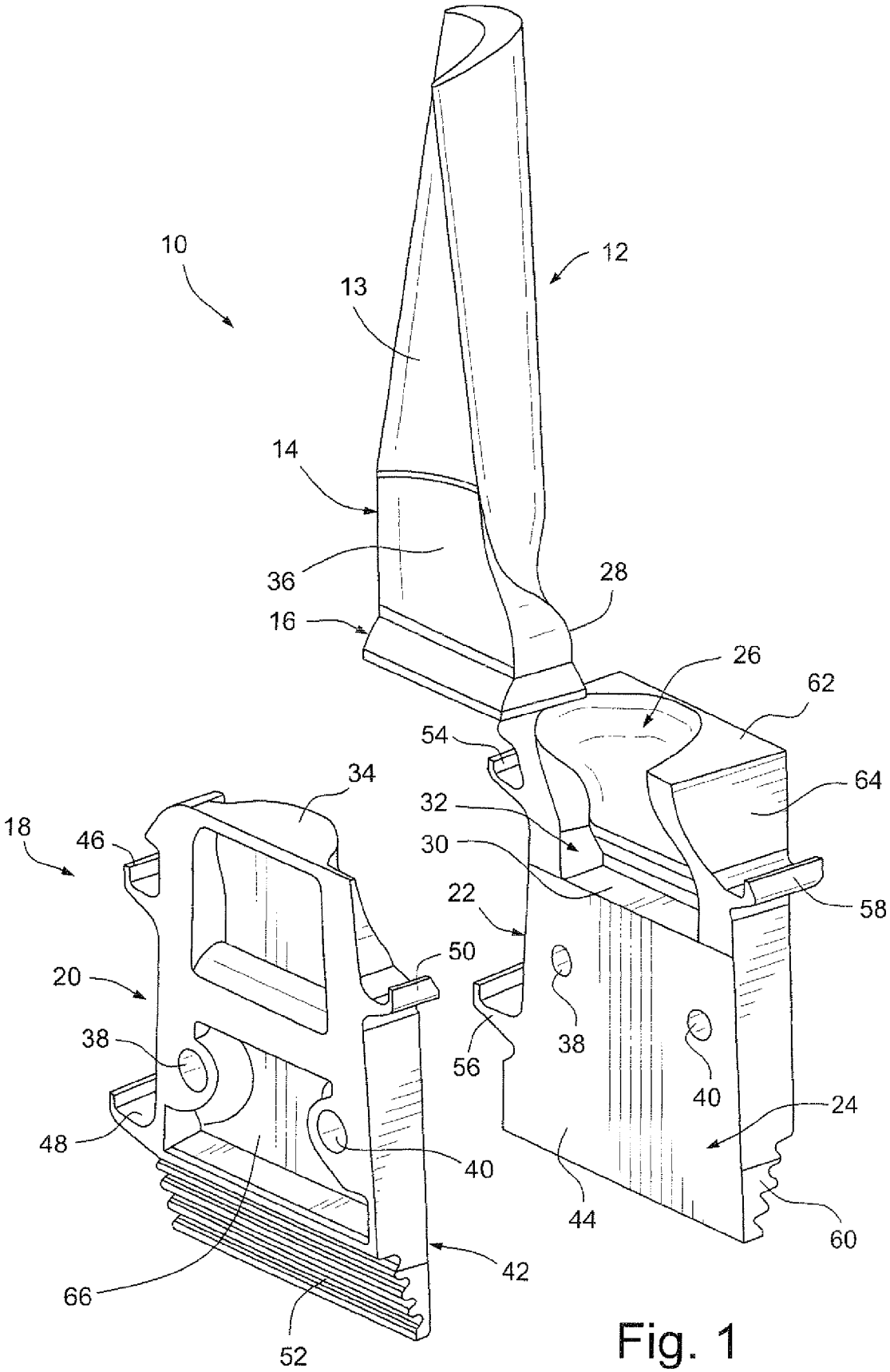
FIG. 1 is an exploded view of an exemplary but non-limiting embodiment of the invention; illustrating a ceramic airfoil and associated transition assembly.
Figure 2:
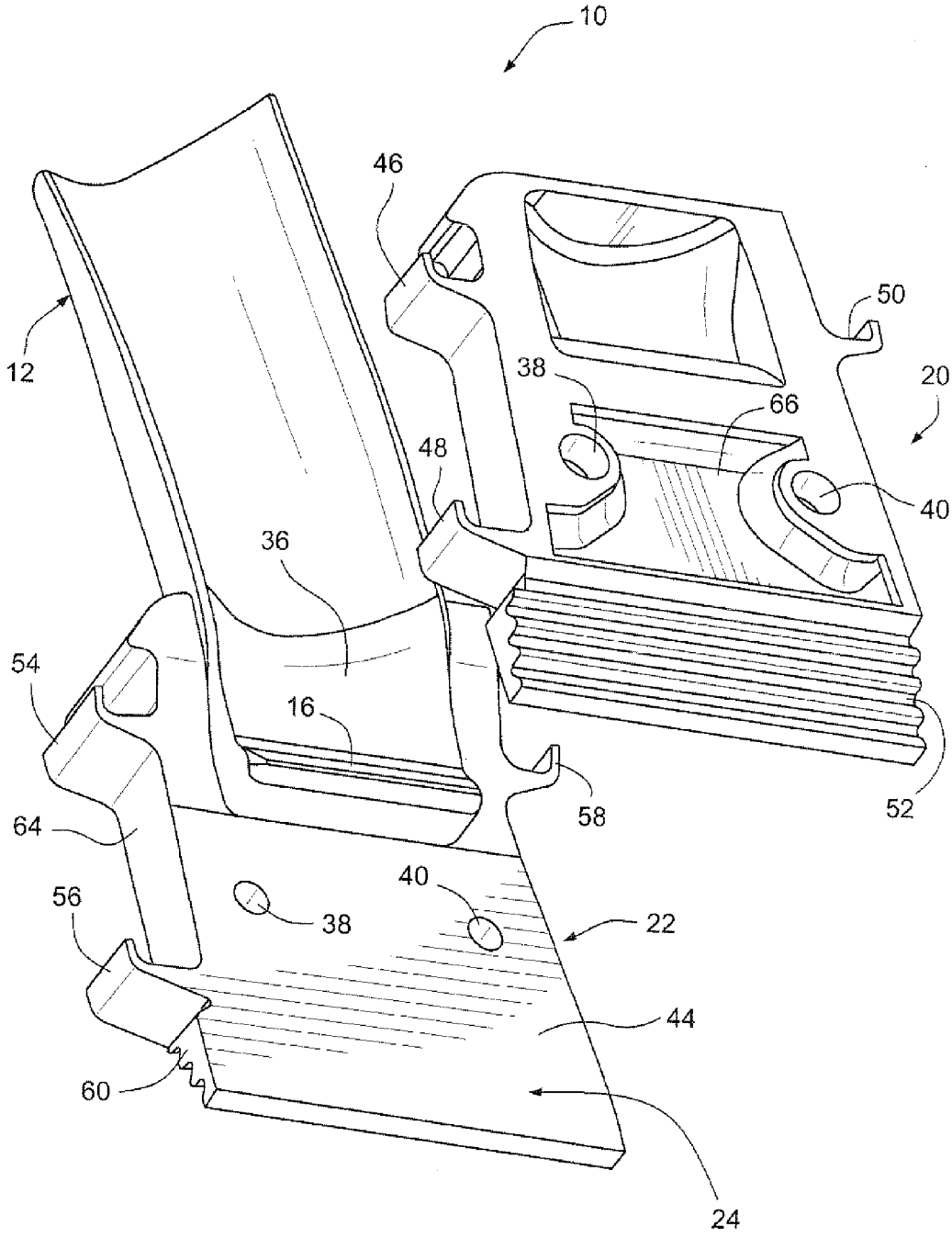
FIG. 2 is a partially-assembled view, illustrating a CMC airfoil nested in one-half of the transition assembly shown in FIG. 1.

More specifically, and with reference to FIGS. 1 and 2, an airfoil assembly 10 includes a ceramic blade 12 which may be made of a ceramic matrix composite (CMC) or other suitable ceramic material such as silicon nitride, silicon oxide, etc. The ceramic blade 12 includes an airfoil portion 13, a first shank portion 14 and a dovetail attachment portion 16. The assembly 10 also includes a metallic transition assembly 18 made up of transition components 20, 22, the interior surfaces of which are formed to permit mating engagement with the pressure and suction sides of the CMC blade 12, and specifically the shank portion 14 and the (first) dovetail attachment portion 16. Thus, and as best seen with respect to the transition component 22, the interior surface 24 is formed with a concave recess 26 which receives the convexly curved or pressure side 28 of the shank portion 14 of the ceramic blade (as related to the pressure side of the airfoil portion 13), as well as a land 30 at the base of a reversely-stepped recess which receives the base or underside of the dovetail attachment portion 16.

The transition component 20 is differently contoured so as to adapt to the suction side of the CMC blade 12. For example, the convex surface 34 receives the corresponding concave surface 36 of the shank portion of the ceramic blade. The inside surface of the component 20 is also formed to include a recess (not visible but generally similar to recess 32) for receiving the other half of the dovetail attachment portion 16. Thus, it will be appreciated that the transition assembly components 20, 22 fit snugly about the shank portion 14 and dovetail attachment portion 16 of the ceramic blade 12, and the two components 20, 22 are subsequently secured together with bolts or other suitable fasteners (not shown) passing through respective bolt hole pairs 38, 40 located radially below (or radially inward relative to the disk or rotor) the airfoil dovetail portion 15, where flat surface regions 42, 44 of the transition components are joined together directly, so that the bolts or other fasteners do not pass through any part of the ceramic blade 12. In this way, the fastening devices (bolts) pass through relatively lower temperature and lower stress locations of the assembly. Surface regions 42, 44 also permit bolt or other fastener clamping loads to be transmitted from one transition component to the other.

Figure 3:
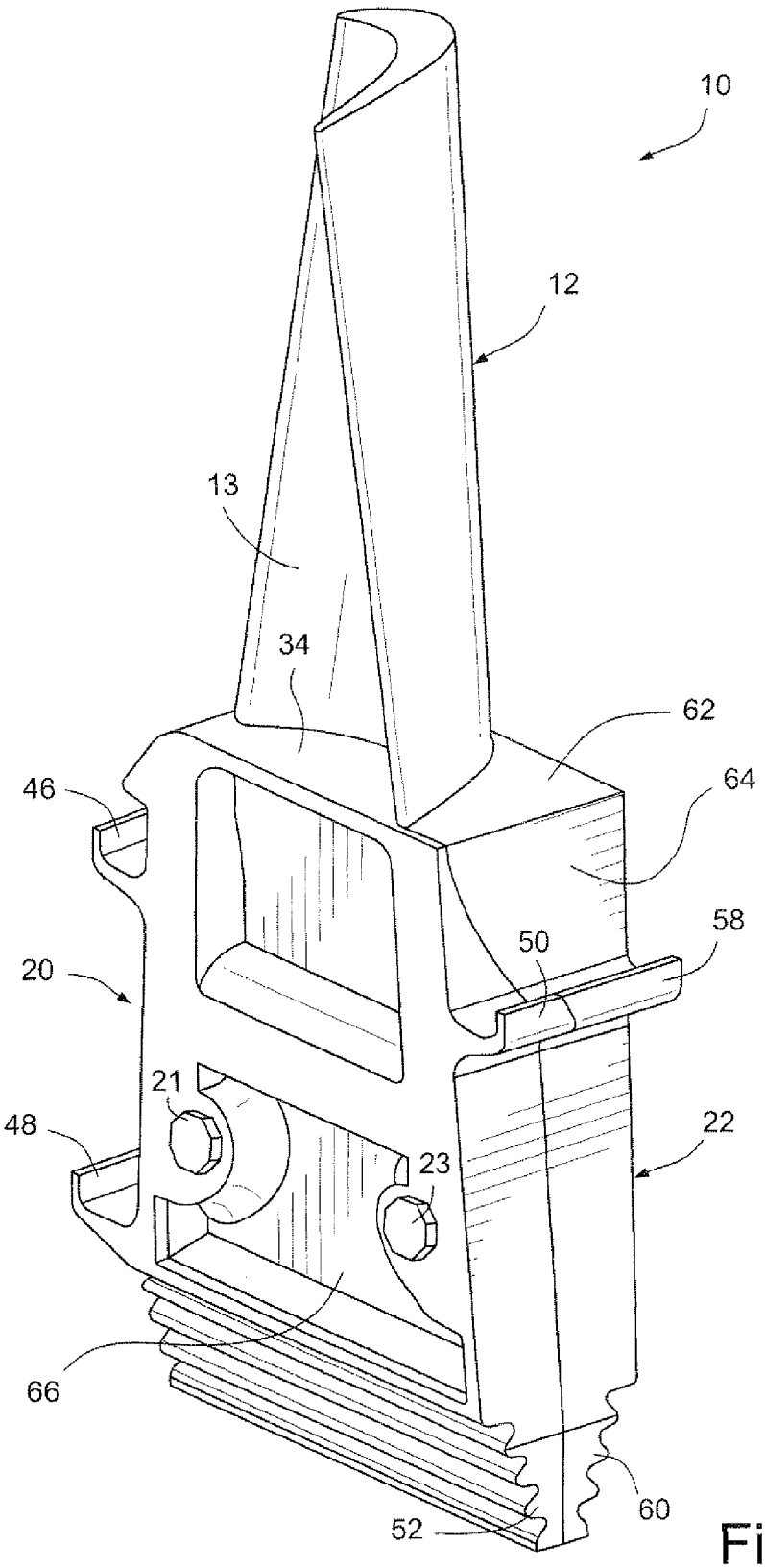
FIG. 3 is a perspective view showing a substantially fully assembled ceramic airfoil and transition assembly.

The exterior surfaces of the transition assembly components 20, 22 are formed to include all of the typical surface features of a metallic bucket or blade shank and dovetail. For example, the exterior surfaces of the components 20 and 22 may be formed to include one or more so-called "angel wing" seals 46, 48, 50, and a (second) dovetail attachment portion 52 on the component 20; and angel wing seal portions 54, 56 and 58 and (second) dovetail attachment portion 60 on the component 22. By so configuring the transition components, no modification of any kind is required to the turbine rotor or disk upon replacement of a metal bucket or blade with the ceramic blade assembly as disclosed herein. Note that the seals 46, 48 and 50 align with seals 54, 56 and 58, respectively and that dovetail attachment portion 52 aligns with dovetail attachment portion 60 when the transition pieces are joined as shown in FIG. 3 to form a complete second dovetail attachment portion. Note also that the exterior surfaces of the first and second transition components 20, 22 are formed to include a platform 62 and a second shank portion 64 that matingly engage the first shank portion 14. Thus, the platform 62 and second shank portion 64, normally part of the blade structure, are now part of the metal transition components.

It will also be appreciated that the transition assembly components 20, 22 are not mirror images of one another in light of the asymmetric profile of the ceramic blade 12. As a result, the interface between the two components 20, 22 is also asymmetrical, but in any event, may be determined not only by the configuration of the ceramic airfoil, but also based on concerns relating to ease of manufacture, weight and stress. Thus the exact configuration of the transition components may vary, depending on the ceramic blade configuration.

FIG. 3 illustrates the fully-assembled bucket wherein the transition components 20, 22 are securely clamped via bolts 21, 23 or other suitable fasteners about the shank portion 14 and first dovetail attachment portion 16 of the ceramic blade 12. Once assembled in this fashion, the assembly may be attached to the turbine disk or rotor in exactly the same way as any of the metal buckets or blades on the disk since the transition assembly components 20 and 22 are shaped to correspond to the original shank and dovetail portions of the replaced metal blade or bucket. Positioning of the one transition component relative to the other is achieved by the fasteners, pins or by a suitable pilot feature.

It will be understood that the present invention provides several benefits in that it allows the ceramic blade 12 to be fairly small and of simple design. In addition, the metal transition assembly may be constructed of a lower grade material than used in a comparable metal bucket or blade, thus enabling additional savings. It has also been determined that there is low stress at the lower temperature sections of the shank portion, and that the transition assembly components 20, 22 effectively collapse into each other due to G loading and the fact that their centers of mass are axially aligned. Further in this regard, the dovetail attachment portion 16 of the blade 12 transfers the CMC airfoil and shank centrifugal loads into to the transition components 20, 22 and the transition components 20, 22, in turn, transfer the combined centrifugal loading to the disk or rotor.

It will also be appreciated that the above description is exemplary only and various design changes are contemplated. For example, in the illustrated embodiment, the first dovetail attachment portion 16 of the ceramic blade 12 is a single tang dovetail. It could, of course, be a multi-tang or other type of attachment. Similarly, the second attachment feature (the second dovetail attachment portion 52, 60) provided on the transition components may be altered, depending on the attachment scheme provided in the associated rotor turbine or disk.

The transition assembly components 20, 22 can also be formed to contain passages for cooling air or other cooling features for the metal assembly as well as features that contain and hold dampers. Other features may be included, such as cut-outs or recesses for weight reduction (one such recess shown at 66).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A composite turbine blade assembly comprising:

a ceramic blade including an airfoil portion, a shank portion and an attachment portion; and a transition assembly adapted to attach said ceramic blade to a turbine disk or rotor, the transition assembly comprising first and second metal transition components clamped together, trapping said ceramic blade therebetween, wherein interior surfaces of said first and second metal transition components are formed to mate with said shank portion and said attachment portion of said ceramic blade and to engage each other radially-inward of said shank portion; and wherein exterior surfaces of said first and second metal transition components are formed to provide an attachment feature enabling said transition assembly to be received in a slot provided in the turbine rotor or disk, wherein a radially innermost end of said attachment portion of said ceramic blade lies radially outwardly of a radially outermost end of said attachment feature of said first and second metal transition components.

2. The composite turbine blade assembly of claim 1 wherein said attachment portion of said ceramic blade comprises a first dovetail attachment portion.

3. The composite turbine blade assembly of claim 2 wherein said interior surfaces of said first and second transition components are formed with complimentary dovetail recesses and lands for receiving said first dovetail attachment portion.

4. The composite turbine blade assembly of claim 1 wherein said attachment feature comprises a dovetail.

5. The composite turbine blade assembly of claim 3 wherein said attachment feature comprises a second dovetail attachment portion receivable within said slot.

6. The composite turbine blade assembly of claim 1 wherein said exterior surfaces of said first and second transition components are formed to include single or plural angel wing seals.

7. The composite turbine blade assembly of claim 3 wherein said first and second transition components are clamped together directly by one or more fasteners in an area radially inward of said ceramic blade.

8. The composite turbine blade assembly of claim 7 wherein said area includes a surface adapted to transmit fastener clamping forces from one of said transition components to the other of said transition components.

9. The composite turbine blade assembly of claim 1 wherein said ceramic blade is comprised of a ceramic matrix composite material.

10. A composite turbine blade assembly comprising:

a ceramic blade including an airfoil portion, a first shank portion and a first dovetail attachment portion; and a transition assembly adapted to attach said ceramic blade to a turbine disk or rotor, the transition assembly comprising first and second transition components having respectively engaged surfaces clamped together, trapping said ceramic blade therebetween; wherein interior surfaces of said first and second transition components are formed to mate with at least said first dovetail attachment portion of said ceramic blade; wherein exterior surfaces of said first and second transition components are formed to include a second dovetail attachment portion enabling said transition assembly to be received within a slot provided in the turbine rotor or disk; and wherein said first and second transition components are clamped together by one or more fasteners radially inward of a radially innermost end of said first dovetail attachment portion and radially outward of a radially outermost end of said second dovetail attachment portion.

11. The composite turbine blade assembly of claim 10 wherein said exterior surfaces of said first and second transition components include at least one angel wing seal.

12. The composite turbine blade assembly of claim 10 wherein said transition assembly is constructed of a metal alloy.

13. The composite turbine blade assembly of claim 10 wherein said ceramic blade is comprised of a ceramic matrix composite material.

14. The composite turbine blade assembly of claim 10 wherein said first and second transition components are secured together by bolts passing through said first and second transition components.

15. The composite turbine blade assembly of claim 10 wherein one or more additional recesses are formed in one or both of said first and second transition components as a weight reduction feature.

16. The composite turbine blade assembly of claim 11 wherein said exterior surfaces of said first and second transition components are formed to also include a platform and a second shank portion for mating engagement with said first platform portion.

17. The composite turbine blade assembly of claim 10 wherein said first and second transition components are formed with respective convex and concave surface features for engaging substantially identical respective surface features on said shank portion of said ceramic blade.

18. The composite turbine blade assembly of claim 14 wherein said respectively engaged surfaces include substantially smooth flat surfaces extending between lands and radially inner edges of said first and second transition components.

19. A turbine rotor or disk assembly comprising:

at least one ceramic blade including an airfoil portion, a first shank portion and first attachment portion; and a transition assembly adapted to attach said at least one ceramic blade to a turbine disk or rotor, the transition assembly comprising first and second transition components having respectively engaged surfaces clamped together, trapping said at least one ceramic blade therebetween; interior surfaces of said first and second transition components formed to mate with said shank portion and said first attachment portion of said at least one ceramic blade; wherein exterior surfaces of said first and second transition components are formed to include a platform, a second shank portion for mating engagement with said first shank portion, one or more angel wing seals and a second attachment portion enabling the transition assembly to be received within a slot provided in the turbine rotor or disk; and wherein a radially innermost end of said first attachment portion is located radially outwardly of a radially outermost end of said second attachment portion.

* * * * *